US007947628B2

(12) United States Patent
Oakley et al.

(10) Patent No.: US 7,947,628 B2
(45) Date of Patent: May 24, 2011

(54) METHOD OF IMPROVING SOLIDS SEPARATION EFFICIENCY

(75) Inventors: Doug Oakley, Wiltshire (GB); Blake Brockerville, Labrador City (CA); Todd Reid, Mount Pearl (CA); Jarrod Massam, Scotland (GB)

(73) Assignee: M-I L.L.C., Houston, TX (US)

( * ) Notice: Subject to any disclaimer, the term of this patent is extended or adjusted under 35 U.S.C. 154(b) by 728 days.

(21) Appl. No.: 11/552,347

(22) Filed: Oct. 24, 2006

(65) Prior Publication Data

US 2008/0093072 A1 Apr. 24, 2008

(51) Int. Cl.
*C09K 8/68* (2006.01)

(52) U.S. Cl. ..... 507/211; 166/267

(58) Field of Classification Search ..... 507/211; 166/267

See application file for complete search history.

(56) References Cited

U.S. PATENT DOCUMENTS

| | | | | |
|---|---|---|---|---|
| 3,766,997 | A * | 10/1973 | Heilhecker et al. | 175/66 |
| 2003/0203822 | A1 * | 10/2003 | Bradbury et al. | 507/200 |
| 2004/0127366 | A1 | 7/2004 | Bradbury et al. | |
| 2005/0277553 | A1 | 12/2005 | Massam et al. | |

FOREIGN PATENT DOCUMENTS

| | | | |
|---|---|---|---|
| EP | 1900412 | A2 | 3/2008 |
| WO | WO 9803609 | A1 * | 1/1998 |

OTHER PUBLICATIONS

European Search Report and Opinion issued in European Patent Application No. EP 07 020 020.9; dated Mar. 26, 2008 (7 pages).
Amendments filed in European Patent Application No. EP 07 020 020.9; dated Jun. 3, 2008 (11 pages).
Communication and Annex from the Examining Division issued in European Patent Application No. EP 07 020 020.9; Dated Jan. 16, 2009 (5 pages).
Reply to Communication and accompanying documents filed in European Patent Application No. EP 07 020 020.9; dated May 6, 2009 (11 pages).
Drunkexemplar issued in European Patent Application No. EP 07 020 020.9; dated Oct. 29, 2009 (31 pages).

* cited by examiner

*Primary Examiner* — Randy Gulakowski
*Assistant Examiner* — Alicia Toscano
(74) *Attorney, Agent, or Firm* — Osha • Liang LLP

(57) ABSTRACT

A method to control drilling fluid properties, including: circulating a drilling fluid through a wellbore to form a suspension of drilled solids in the drilling fluid; and separating the suspension in a separator to form a particulate fraction and an effluent, wherein the particulate fraction includes at least a portion of the drilled solids and the effluent includes the drilling fluid. The particulate fraction may include particulates having a minimum particle size of 100 microns or greater, and the effluent may include a micronized weighting agent having a particle size $d_{90}$ of 10 microns or less.

16 Claims, 1 Drawing Sheet

METHOD OF IMPROVING SOLIDS SEPARATION EFFICIENCY

FIELD OF THE INVENTION

Embodiments disclosed herein relate generally to drilling fluids, weighting agents, and processes to separate drill cuttings from drilling fluids and weighting agents.

BACKGROUND

When drilling or completing wells in earth formations, various fluids typically are used in the well for a variety of reasons. Common uses for well fluids include lubrication and cooling of drill bit cutting surfaces while drilling generally or drilling-in (i.e., drilling in a targeted petroliferous formation), transportation of "cuttings" (pieces of formation dislodged by the cutting action of the teeth on a drill bit) to the surface, controlling formation fluid pressure to prevent blowouts, maintaining well stability, suspending solids in the well, minimizing fluid loss into and stabilizing the formation through which the well is being drilled, fracturing the formation in the vicinity of the well, displacing the fluid within the well with another fluid, cleaning the well, testing the well, transmitting hydraulic horsepower to the drill bit, emplacing a packer, abandoning the well or preparing the well for abandonment, and otherwise treating the well or the formation.

In general, drilling and completion fluids should be pumpable under pressure down through strings of drill pipe, then through and around the drill bit head deep in the earth, and then back to the surface through an annulus between the outside of the drill stem and the hole wall or casing. Beyond providing drilling lubrication and efficiency, and retarding wear, drilling fluids should suspend and transport solid particles, drill cuttings, to the surface for screening and disposal. In addition, the fluids should be capable of suspending additive weighting agents (to increase specific gravity of the fluid), generally finely ground barites (barium sulfate ore), and transport clay and other substances capable of adhering to and coating the borehole surface.

Drilling and completion fluids are generally characterized as thixotropic fluid systems. That is, they exhibit low viscosity when sheared, such as when in circulation (as occurs during pumping or contact with the moving drilling bit). However, when the shearing action is halted, the fluid should be capable of suspending the solids it may contain, to prevent gravity separation. In addition, when the drilling fluid is under shear conditions and a free-flowing near-liquid, it must retain a sufficiently high enough viscosity to carry all unwanted particulate matter from the bottom of the well bore to the surface. The drilling fluid formulation should also allow the cuttings and other unwanted particulate material to be removed or otherwise settle out from the liquid fraction, such as during screening.

There is an increasing need for drilling fluids having these rheological profiles that enable wells to be drilled more efficiently. Drilling and completion fluids having tailored rheological properties ensure that cuttings are removed from the wellbore as efficiently and effectively as possible to avoid the formation of cuttings beds in the well which can cause the drill string to become stuck, among other issues. There is also the need from a drilling fluid hydraulics perspective (equivalent circulating density) to reduce the pressure required to circulate the fluid, helping to avoid exposing the formation to excessive forces that can fracture the formation causing the fluid, and possibly the well, to be lost In addition, an enhanced profile is necessary to prevent settlement or sag of the weighting agent in the fluid, because if this occurs, it can lead to an uneven density profile within the circulating fluid system, possibly resulting in loss of well control (gas/fluid influx) and wellbore stability problems (caving/fractures).

To obtain the fluid characteristics required to meet these challenges, the fluid must be easy to pump, so it requires the minimum amount of pressure to force it through restrictions in the circulating fluid system, such as bit nozzles or downhole tools. In other words, the fluid must have the lowest possible viscosity under high shear conditions. Conversely, in zones of the well where the area for fluid flow is large and the velocity of the fluid is slow or where there are low shear conditions, the viscosity of the fluid needs to be as high as possible in order to suspend and transport the drilled cuttings. This also applies to the periods when the fluid is left static in the hole, where both cuttings and weighting materials need to be kept suspended to prevent settlement. However, it should also be noted that the viscosity of the fluid should not continue to increase under static conditions to unacceptable levels. Otherwise, when the fluid needs to be circulated again, this can lead to excessive pressures that can fracture the formation or, alternatively, can lead to lost time if the force required to regain a fully circulating fluid system is beyond the limits of the pumps.

Wellbore fluids must also contribute to the stability of the well bore, and control the flow of gas, oil, or water from the pores of the formation in order to prevent, for example, the flow or blow out of formation fluids or the collapse of pressured earth formations. The column of fluid in the hole exerts a hydrostatic pressure proportional to the depth of the hole and the density of the fluid. High-pressure formations may require a fluid with a specific gravity as high as 3.0.

A variety of materials are presently used to increase the density of wellbore fluids. These include dissolved salts such as sodium chloride, calcium chloride, and calcium bromide. Alternatively, powdered minerals such as barite, calcite, dolomite, ilmenite, siderite, hausmannite (manganese tetroxide), hematite and other iron ores, and olivine are added to a fluid to form a suspension of increased density. The use of finely divided metal, such as iron, as a weight material in a drilling fluid, where the weight material includes iron/steel ball-shaped particles having a diameter less than 250 microns and preferentially between 15 and 75 microns has also been described.

One requirement of these wellbore fluid additives is that they form a stable suspension and do not readily settle out. A second requirement is that the suspension exhibits a low viscosity in order to facilitate pumping and to minimize the generation of high pressures. Finally, the wellbore fluid slurry should also exhibit low fluid loss.

Conventional weighting agents such as powdered barite exhibit an average particle diameter ($d_{50}$) in the range of 10-30 microns. A gellant, such as bentonite for water-based fluids or organically modified bentonite for oil-based fluids, is required to adequately suspend these materials. A soluble polymer viscosifier such as xanthan gum may be also added to slow the sedimentation rate of the weighting agent. However, as more gellant is added to increase the suspension stability, the fluid viscosity (plastic viscosity and/or yield point) increases undesirably, resulting in reduced pumpability. This is also the case if a viscosifier is used to maintain a desirable level of solids suspension.

The sedimentation (or "sag") of particulate weighting agents becomes more critical in well bores drilled at high angles from the vertical, in that a sag of, for example, one inch (2.54 cm) can result in a continuous column of reduced-density fluid along the upper portion of the wellbore wall.

Such high angle wells are frequently drilled over large distances in order to access, for example, remote portions of an oil reservoir. In such instances, it is important to minimize the plastic viscosity of a drilling fluid in order to reduce the pressure losses over the borehole length. At the same time, a high density should also be maintained to prevent a blow out. Further, as noted above, with particulate weighting materials, the issue of sag becomes increasingly important to avoid differential sticking or the settling out of the particulate weighting agents on the low side of the wellbore.

Being able to formulate a drilling or completion fluid having a high density and a low plastic viscosity is also important in deep, high pressure wells where high-density wellbore fluids are required. High viscosities can result in an increase in pressure at the bottom of the hole under pumping conditions. This increase in "Equivalent Circulating Density" (ECD) can result in the opening of fractures in the formation and serious losses of the wellbore fluid into the fractured formation. Again, the stability of the suspension is important in order to maintain the hydrostatic head to avoid a blow out.

After formulating a drilling fluid with desired rheological properties, one challenge during the drilling process is maintaining the properties of the drilling fluid during recycle and reuse. For example, as mentioned above, the drilling fluids transport solid particles, drilled solids, to the surface for screening and disposal. Recycling drilled solids into the wellbore is undesirable, as this can result in smaller sizes of drilled solids which can accumulate in the drilling fluid, ultimately affecting the properties of the drilling fluid. If the solids content increases, additional drilling fluid (water, oil, etc.) and other chemicals must be added to maintain the drilling fluid at its desired density, viscosity, and other physical and chemical properties for the drilling fluid to satisfy the requirements for drilling a wellbore. The drilling fluid and drill cuttings returned to the surface are often separated to maintain drilling fluid weight, thus avoiding costly dilution. The separated solids are then discarded or disposed of in an environmentally accepted manner.

Drill cuttings can originate from different geological strata, including clay, rock, limestone, sand, shale, underground salt mines, brine, water tables, and other formations encountered while drilling oil and gas wells. Cuttings originating from these varied formations can range in size from less than two microns to several hundred microns, including clays, silt, sand, and larger drill cuttings. Several types of separation equipment have been developed to efficiently separate the varied sizes of the weighting materials and drill cuttings from the drilling fluid, including shakers (shale, rig, screen), screen separators, centrifuges, hydrocyclones, desilters, desanders, mud cleaners, mud conditioners, dryers, filtration units, settling beds, sand traps, and the like. Centrifuges and like equipment can speed up the separation process by taking advantage of both size and density differences in the mixture being separated.

A typical process used for the separation of drill cuttings and other solids from drilling fluid is shown in FIG. 1, illustrating a stage-wise separation according to size classifications. Drilling fluid 2 returned from the well (not shown) and containing drill cuttings and other additives can be separated in a shale shaker 4, resulting in large particles 5, such as drill cuttings (greater than 500 microns for example), and effluent 6. The drilling fluid and remaining particles in effluent 6 can then be passed through a degasser 8, removing entrained gases; a desander 10, removing sand 15; a desilter 12, removing silt 16; and a centrifuge 14, removing even smaller particles 17. The solids 15, 16, 17 separated, including any weighting materials separated, are then discarded and the clean drilling fluid 18 can be recycled to the drilling fluid mixing system (not shown). Agitated tanks (not numbered) can be used between separation stages as holding/supply tanks.

The recovered, clean fluid can be recycled; however, the drilling fluid formulation must often be adjusted due to compounds lost during the drilling process and imperfect separation of drill cutting particles and other drilling fluid additives. As examples of imperfect separations, drilling fluid can be absorbed or retained with drill cuttings during separation; conversely, drill cuttings having a small size can remain with the drilling mud after separations. Losses during the drilling process can occur due to the mud forming a filter cake, and thus depositing drilling fluid additives on the wall of the wellbore.

Another example of losses includes the loss of drilling fluid additives with the separated drilled solids. It is well known to the drilling fluid industry that screen sizes of about 240 mesh ($d_{100}$ of about 100 to 120 microns [API 13C]) will remove significant quantities of drilling grade barite ($d_{90}$ of about 75 microns) together with drilled solids from a drilling fluid. Reconciling the requirement to dress shakers with sufficiently small aperture sized screens to remove unwanted drilled solids, without simultaneously removing valuable barite is difficult to achieve in practice. For example, U.S. Pat. No. 3,766,997, issued to Heilhecker et al., states that because the particle size of barite and low gravity solids overlap it is impossible to remove all the unwanted drilled solids.

Accordingly, there exists a need for a drilling fluid system, including various additives and separation equipment, where the drilling muds have desired rheological profiles, and where the characteristics of the drilling mud allow for improved solids separation efficiency.

SUMMARY OF INVENTION

In one aspect, embodiments disclosed herein relate to a method to control drilling fluid properties. The method may include: circulating a drilling fluid through a wellbore to form a suspension of drilled solids in the drilling fluid; and separating the suspension in a separator to form a particulate fraction and an effluent, wherein the particulate fraction includes at least a portion of the drilled solids and the effluent includes the drilling fluid. The particulate fraction may include particulates having a minimum particle size of 100 microns or greater, and the effluent may include a micronized weighting agent having a particle size $d_{90}$ of 10 microns or less.

In another aspect, embodiments disclosed herein relate to a process for the separation of components of a mixture of materials, where the mixture may include drilling fluid, drilled solids, and one or more micronized weighting agents from a mud system. The process may include separating at least a portion of the drilled solids from the mixture to form an effluent and a drilled solids fraction, wherein the effluent may include the drilling fluid and the one or more micronized weighting agents, and wherein the one or more micronized weighting agents have a particle size $d_{90}$ of 20 microns or less.

In another aspect, embodiments disclosed herein relate to a system for the separation of drilling fluid and additives from a mixture of materials. The mixture may include a base drilling fluid, drilled solids, and one or more micronized weighting agents from a mud system. The separation system may include a fluid connection to transport the mixture from the mud system to a first separator, wherein the first separator separates at least a portion of the drilled solids from the mixture to form a first effluent and a drilled solids fraction, wherein the first effluent comprises the base drilling fluid and a micronized weighting agent having a particle size $d_{90}$ of 10 microns or less, and wherein the first separator is configured to have a minimum particle size cut between about 10 microns and about 100 microns.

Other aspects and advantages of the invention will be apparent from the following description and the appended claims.

DETAILED DESCRIPTION

Figure 1:
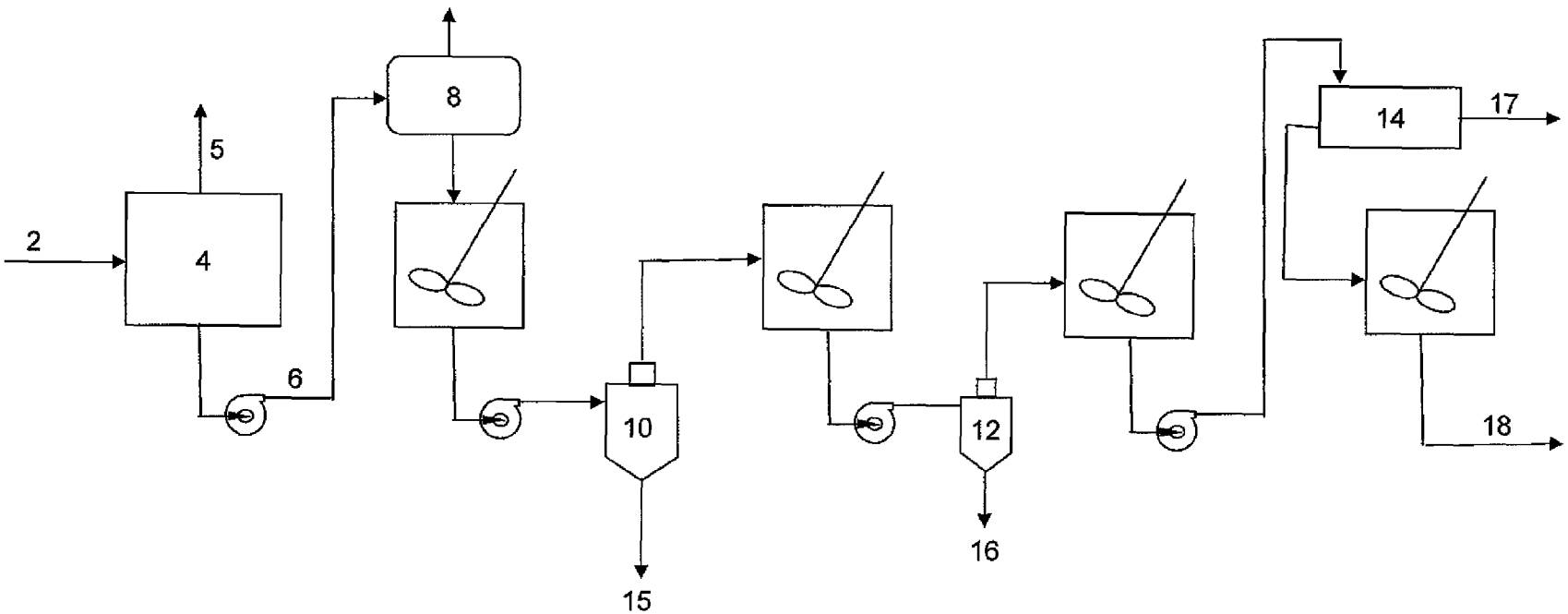
FIG. 1 (Prior Art)
FIG. 1 presents a simplified flow diagram of a prior art solids separation process.

In one aspect, embodiments disclosed herein relate to the use of micronized weighting agents in drilling and completion fluids. In another aspect, embodiments disclosed herein relate to a drilling and completion fluid system for use of micronized weighting agents, where the mud system may be configured to efficiently separate drill cuttings from the drilling fluid and the micronized weighting agents. Other embodiments disclosed herein relate to the use of micronized weighting agents having a particle size $d_{90}$ of less than 10 microns, allowing for efficient separation of drill cuttings and efficient control of the properties of the drilling mud (weight, rheological properties, etc.).

Micronized Weighting Agent

Weighting agents used in embodiments disclosed herein may include a variety of compounds well known to one of skill in the art, In a particular embodiment, the weighting agent may be selected from materials including, for example, barium sulphate (barite), calcium carbonate, dolomite, ilmenite, hematite, olivine, siderite, strontium sulphate, and other minerals. In some embodiments, these weighting agents may be chemically modified. One having ordinary skill in the art would recognize that selection of a particular material may depend largely on the density of the material, as the lowest wellbore fluid viscosity at any particular density is typically obtained by using the highest density particles. However, other considerations may influence the choice of product, such as cost, local availability, the power required for grinding, and whether the residual solids or filter cake may be readily removed from the well.

In one embodiment, the weighting agent may be a micronized weighting agent having a $d_{90}$ ranging from 1 to 25 microns and a $d_{50}$ ranging from 0.5 to 10 microns. In another embodiment, the micronized weighting agent includes particles having a $d_{90}$ ranging from 2 to 8 microns and a $d_{50}$ranging from 0.5 to 4 microns. In various other embodiments, the micronized weighting agent includes particles having a $d_{90}$ of 20 microns or less, 15 microns or less, 10 microns or less, or 5 microns or less. Particle size measurements, including particle size $d_{50}$ and $d_{90}$, may be performed using laser diffractometry or other methods common in the art. The $d_{50}$ ($d_{90}$) is a value on the distribution such that 50% (90%) of the particles have a particle size of this value or less.

One of ordinary skill in the art would recognize that, depending on the sizing technique, the weighting agent may have a particle size distribution other than a monomodal distribution. That is, the weighting agent may have a particle size distribution that, in various embodiments, may be monomodal, which may or may not be Gaussian, bimodal, or polymodal, The use of sized weighting agents has been disclosed in U.S. Patent Application Publication No. 20050277553, assigned to the assignee of the current application, and herein incorporated by reference. Particles having these size distributions may be obtained by several means. For example, sized particles, such as a suitable barite product having similar particle size distributions as disclosed herein, may be commercially purchased. A coarser ground material may be obtained, and the material may be further ground by any known technique to the desired particle size. Such techniques include jet-milling, high performance dry milling techniques, or any other technique that is known in the art generally for milling powdered products. In one embodiment, appropriately sized particles of barite may be selectively removed from a product stream of a conventional barite grinding plant, which may include selectively removing the fines from a conventional API barite grinding operation. Fines are often considered a by-product of the grinding process, and conventionally these materials are blended with courser materials to achieve API grade barite. However, in accordance with the present disclosure, these by-product fines may be further processed via an air classifier to achieve the particle size distributions disclosed herein. In yet another embodiment, the micronized weighting agents may be formed by chemical precipitation. Such precipitated products may be used alone or in combination with mechanically milled products.

In one embodiment, the weighting agent may be a coated weighting agent. In some embodiments, the weighting agent may be coated by a wet coating process or a dry coating process. The coated weighting agent, in some embodiments, may be coated with a dispersant by a dry blending process, such as disclosed in U.S. patent application Ser. No. 60/825,156, filed Sep. 11, 2006, assigned to the assignee of the present application and herein incorporated by reference. The resulting coated weighting agent may be added in new drilling fluid formulations or added to existing formulations. The term "dry blending" refers to a process in which the weighting agent is mixed and coated with a dispersant in the absence of a solvent. The coated weighting agent, in other embodiments, may be coated with a dispersant in the presence of solvent generating colloidal coated particles, such as disclosed in U.S. Patent Application Publication No. 20040127366, assigned to the assignee of the present application, and herein incorporated by reference, As used herein, "micronized weighting agent" refers to weighting agents having particle size distribution reduced below conventional API specified distribution. Finally, one skilled in the art would recognize that the weighting agent may be dry blended with the dispersant in a comminution process (such as grinding) or by other means, such as thermal desorption, for example.

Use in Wellbore Formulations.

In accordance with one embodiment, the micronized weighting agent may be used in a wellbore fluid formulation. The wellbore fluid may be a water-based fluid, an invert emulsion, or an oil-based fluid.

Water-based wellbore fluids may have an aqueous fluid as the base fluid and a micronized weighting agent. The aqueous fluid may include at least one of fresh water, sea water, brine, mixtures of water and water-soluble organic compounds and mixtures thereof. For example, the aqueous fluid may be formulated with mixtures of desired salts in fresh water. Such salts may include, but are not limited to alkali metal chlorides, hydroxides, or carboxylates, for example. In various embodiments of the drilling fluid disclosed herein, the brine may include seawater, aqueous solutions wherein the salt concentration is less than that of sea water, or aqueous solutions wherein the salt concentration is greater than that of sea water. Salts that may be found in seawater include, but are not limited to, sodium, calcium, sulfur, aluminum, magnesium, potassium, strontium, silicon, lithium, and phosphorus salts of chlorides, bromides, carbonates, iodides, chlorates, bromates, formates, nitrates, oxides, and fluorides. Salts that may be incorporated in a brine include any one or more of those present in natural seawater or any other organic or inorganic dissolved salts. Additionally, brines that may be used in the drilling fluids disclosed herein may be natural or synthetic, with synthetic brines tending to be much simpler in constitution. In one embodiment, the density of the drilling fluid may be controlled by increasing the salt concentration in the brine (up to saturation). In a particular embodiment, a brine may include halide or carboxylate salts of mono- or divalent cations of metals, such as cesium, potassium, calcium, zinc, and/or sodium.

The oil-based/invert emulsion wellbore fluids may include an oleaginous continuous phase, a non-oleaginous discontinuous phase, and a micronized weighting agent. One of ordinary skill in the art would appreciate that the micronized weighting agents described above may be modified in accordance with the desired application. For example, modifications may include the hydrophilic/hydrophobic nature of the dispersant.

The oleaginous fluid may be a liquid, more preferably a natural or synthetic oil, and more preferably the oleaginous fluid is selected from the group including diesel oil; mineral oil; a synthetic oil, such as hydrogenated and unhydrogenated olefins including polyalpha olefins, linear and branch olefins and the like, polydiorganosiloxanes, siloxanes, or organosiloxanes, esters of fatty acids, specifically straight chain, branched and cyclical alkyl ethers of fatty acids; similar compounds known to one of skill in the art; and mixtures thereof. The concentration of the oleaginous fluid should be sufficient so that an invert emulsion forms and may be less than about 99% by volume of the invert emulsion. In one embodiment, the amount of oleaginous fluid is from about 30% to about 95% by volume and more preferably about 40% to about 90% by volume of the invert emulsion fluid. The oleaginous fluid, in one embodiment, may include at least 5% by volume of a material selected from the group including esters, ethers, acetals, dialkylcarbonates, hydrocarbons, and combinations thereof.

The non-oleaginous fluid used in the formulation of the invert emulsion fluid disclosed herein is a liquid and may be an aqueous liquid. In one embodiment, the non-oleaginous liquid may be selected from the group including sea water, a brine containing organic and/or inorganic dissolved salts, liquids containing water-miscible organic compounds, and combinations thereof. The amount of the non-oleaginous fluid is typically less than the theoretical limit needed for forming an invert emulsion. Thus, in one embodiment, the amount of non-oleaginous fluid is less that about 70% by volume, and preferably from about 1% to about 70% by volume. In another embodiment, the non-oleaginous fluid is preferably from about 5% to about 60% by volume of the invert emulsion fluid. The fluid phase may include either an aqueous fluid or an oleaginous fluid, or mixtures thereof. In a particular embodiment, coated barite or other micronized weighting agents may be included in a wellbore fluid having an aqueous fluid that includes at least one of fresh water, sea water, brine, and combinations thereof The fluids disclosed herein are especially useful in the drilling, completion and working over of subterranean oil and gas wells. In particular the fluids disclosed herein may find use in formulating drilling muds and completion fluids that allow for the easy and quick removal of the filter cake. Such fluids are especially useful in the drilling of slant or horizontal wells into hydrocarbon bearing formations.

Conventional methods can be used to prepare the drilling fluids disclosed herein in a manner analogous to those normally used, to prepare conventional water- and oil-based drilling fluids. In one embodiment, a desired quantity of water-based fluid and a suitable amount of one or more micronized weighting agents, as described above, are mixed together and the remaining components of the drilling fluid added sequentially with continuous mixing. In another embodiment, a desired quantity of oleaginous fluid such as a base oil, a non-oleaginous fluid, and a suitable amount of one or more micronized weighting agents are mixed together and the remaining components are added sequentially with continuous mixing. An invert emulsion may be formed by vigorously agitating, mixing, or shearing the oleaginous fluid and the non-oleaginous fluid.

Other additives that may be included in the wellbore fluids disclosed herein include, for example, wetting agents, organophilic clays, viscosidiers, fluid loss control agents, surfactants, dispersants, interfacial tension reducers, pH buffers, mutual solvents, thinners, thinning agents, and cleaning agents. The addition of such agents should be well known to one of ordinary skill in the art of formulating drilling fluids and muds.

Solids Control

As described above with respect to FIG. 1, separation of drilling fluids, drilling fluid additives, and conventional weighting agents from drilled solids may involve mulseparation stages employing multiple apparatuses to achieve the desired separation of the drilled solids and to maintain control of drilling mud properties. In contrast, embodiments disclosed herein may provide for more efficient separation of drilled solids and may provide for improved control of drilling mud properties, as will be described further below.

Drilling mud, containing a base drilling fluid, at least one micronized weighting agent as described above (such as micronized treated barite), and optionally other additives, as needed, circulates down through a drill pipe or drill string, out the drill bit, picks up drill cuttings, and the mixture circulates back to the surface. Optionally, an initial separation stage may be used to separate large particles and drill cuttings from the mixture. At least a portion of the mixture, either from the drill string or from a prior separation stage, containing drill cuttings, drilling fluid, micronized weighting agents, and other additives, may be fed to a separator, which separates the mixture into particles and an effluent. In some embodiments, the separator separates a fraction of the drill cuttings and other mixture components having an average particle size greater than an average particle size of the micronized weighting agent in the mixture such that at least a fraction of the micronized weighting agent may remain with the effluent, along with other particles not separated in the separator. In other embodiments, a majority of the micronized weighting agent may remain with the effluent. One of ordinary skill in the art would recognize that additional equipment including vessels, pumps, augers, valves, and the like may be required for the process.

The separator, in some embodiments, may include one or more shakers, multi-deck shakers, screen separators, centrifuges, hydrocyclones, filtration systems, or the like, or combinations thereof. The separator may be configured to separate the mixture into an effluent and particles, where the effluent may include drilling fluid and at least a portion of the micronized weighting agent and the particles may include drilled solids and other similarly sized particles.

In some embodiments, the separator may be configured to separate the mixture into an effluent and particles, where the effluent is essentially free of drilled solids having a particle size of 70 microns or larger. In other embodiments, the separator may be configured to separate the mixture into an effluent and particles, where the effluent is essentially free of drilled solids having a particle size of 50 microns or larger; 25 microns or larger in other embodiments; 15 microns in other embodiments; and 10 microns or larger in yet other embodiments.

For example, the separator, in some embodiments, may be a shale shaker having one or more screen assemblies. The screen assemblies may include screens having an API RP 13C $d_{100}$ of 120 microns or larger. As is known in the art, the $d_{100}$ may vary depending upon the mesh designation (84 mesh, 105 mesh, etc.) and mesh type (XR, HC, and XL), and the use of API RP 13C $d_{100}$ designations may enable a person skilled in the art to recognize the size of particles separated as compared to the size of particles passing through the screen without regard to screen type. In other embodiments, the screen assemblies may include screens having an API RP 13C $d_{100}$ of 100 microns or larger; 70 microns or larger in other embodiments; 50 microns or larger in other embodiments; 25 microns or larger in other embodiments; 15 microns or larger in other embodiments; 10 microns or larger in yet other embodiments.

The API RP 13C cut point test procedure utilizes a series of standard-size screens (sieves) for designating shaker screens. The shaker screen designation is identified by matching the screen's cut point to the closest ASTM sieve cut point. The cut point test uses aluminum oxide, a Rotap, a set of ASTM sieves, a test screen, and a digital scale for weighing the quantity of test particles retained by the test screen. The $d_{100}$ cut point is used for assigning screen designations. $D_{100}$ means that 100 percent of the particles larger than the test screen will be retained, and all finer particles will pass through. After conducting three Rotap tests, the results are averaged, and the screen is given an API number of the test sieve having the closest $d_{100}$ cut point.

The separator, in some embodiments, may allow a majority of the micronized weighting agent to remain with the effluent. The effluent, in some embodiments, may be recycled through the mud system without the need for further processing. In other embodiments, the effluent may be recycled to the mud system, without the need for further processing, and without resulting in significant changes in the weight or rheological properties of the drilling fluid.

The particles may optionally be further processed to separate the materials into various particulate fractions. For example, the particles may be separated based upon size, density, or both, to at least partially recover drilling fluid additives and weighting agents having a similar size to that of the drilled cuttings in the particles separated.

The effluent may optionally be further processed to separate the materials into various fractions. For example, when drilling a formation resulting in accumulation of sand or silt in the drilling fluid, the effluent may be further processed to separate the materials based upon size, density, or both, to at least partially separate the drilling fluid, micronized weighting agent, and other particles of similar size passing through the separator along with the drilling fluid. For example, the effluent may be fed to one or more additional separators, which may include centrifuges, desanders, desilters, mud cleaners, screen separators, shakers, hydrocyclones, or the like, and combinations thereof. The recovered fractions, such as clean drilling fluid, micronized weighting agents, any other additives recovered from additional separators, may be recycled to the mud system as needed.

In one embodiment, a micronized weighting agent having a particle size $d_{90}$ of 10 microns or less is added to a drilling fluid. The drilling mud is then circulated down through the drill pipe or drill string, out the drill bit, picks up drill cuttings, and the mixture circulates back to the surface. At least a portion of the mixture may be fed to a separator, which separates the mixture into a drill cuttings fraction and an effluent, where at least a majority of the micronized weighting agent remains with the drilling fluid in the effluent. With appropriate selection of the separator and particle size cut obtained by the separator, at least a majority of the drill cuttings may be separated from the drilling mud in a single separation stage. In this manner, the drilling mud weight and rheological properties may be maintained with limited pieces of equipment.

In another embodiment, a micronized weighting agent having a particle size $d_{90}$ of 10 microns or less is added to a drilling fluid. The drilling mud is then circulated down through the drill pipe or drill string, out the drill bit, picks up drill cuttings, and the mixture circulates back to the surface. A fluid connection may transport the mixture from the mud system to a separator, which separates the mixture into a drill cuttings fraction and an effluent, where at least a majority of the micronized weighting agent remains with the drilling fluid in the effluent. In some embodiments, the fluid connection may transport the mixture from the mud system to the separator without a processing step therebetween, i.e. directly or indirectly transporting the mixture without a substantive separation stage or other processes for treating, reacting, or partitioning of the mixture components. With appropriate selection of the separator and particle size cut obtained by the separator, at least a majority of the drill cuttings may be separated from the drilling mud in a single separation stage. In this manner, the drilling mud weight and rheological properties may be maintained with limited pieces of equipment. For example, it may be possible to maintain the desired drilling mud properties using only a shale shaker, without the need for further equipment such as driers, centrifuges, hydrocyclones, and the like.

Additionally, an appropriate minimum particle size cut may allow for increased separation of drill cuttings from the drilling mud as compared to conventional processes. For example, in some embodiments, the separator may be configured to have a minimum particle size cut between about 10 microns and about 100 microns. In other various embodiments, the separator may be configured to have a minimum particle size cut of 5, 10, 15, 25, 50, 70, or 100 microns, such that at least a majority of the micronized weighting agent remains with the drilling fluid.

EXAMPLES

The rheology of API Barite weighted fluids was compared to the rheology of a fluid system containing micronized, treated weight agents. Micronized polyacrylate coated barite and uncoated barite were used in an otherwise equivalently formulated 13.2 pounds per gallon (ppg) drilling fluids. Rheological properties were determined using a Fann Model 35 viscometer, available from Fann Instrument Company. Fluid loss was measured with a saturated API high temperature, high pressure (HTHP) cell. Gel strength (i.e., measure of the suspending characteristics or thixotropic properties of a fluid) was evaluated by the 10 minute gel strength in pounds per 100 square feet, in accordance with procedures in API Bulletin RP 1313-2, 1990. The results are shown in Table 1 below.

TABLE 1

| | | API Barite weighted fluids | Micronized treated barite fluids |
|---|---|---|---|
| Mud Weight | (lb/gal) | 13.2 | 13.2 |
| Fan 35 Rheology | | | |
| 600 rpm | | 87 | 57 |
| 300 rpm | | 52 | 32 |
| 200 rpm | | 40 | 23 |
| 100 rpm | | 27 | 14 |
| 60 rpm | | 21 | 10 |
| 30 rpm | | 16 | 6 |
| 6 rpm | | 11 | 3 |
| 3 rpm | | 10 | 2 |
| Gel Strength | (10 sec/10 min) | 15/30 | 4/6 |
| Plastic Viscosity | (cps) | 35 | 25 |
| Yield Point | (lbs/100 sq. ft.) | 17 | 7 |
| Low shear yield point | (twice 3 rpm value minus 6) | 9 | 1 |
| HTHP Fluid Loss | | <2 mls | <2 mls |
| Low Gravity Solids | | <6% | <6% |
| Water Activity | | 0.85 to 0.93 | 0.85 to 0.93 |

As shown in Table 1, the rheological properties of fluids using treated barite as a micronized weighting agent have characteristically very low rheologies and lower barite sag as compared to those with API Specification Barite. Plastic viscosity (PV) and yield point (YP) are substantially reduced from 35 cP to 25 cP; and 17 to 7 lb/100 $ft^2$, respectively. The low shear-rate rheology expressed as the 6 and 3 rpm values are reduced from greater than 10 to less than 4 using treated barite weight material. Gel strengths are also reduced, while all other essential drilling fluid parameters, including high-temperature, high pressure (HTHP) fluid-loss control and water activity, are similar. For the reasons mentioned previously, these unique formulated treated barite fluids may be advantageous in critical and extreme well sections, such as in the North Sea, for extended reach, through tubing, and HTHP wells.

Case 1

A 3,179-ft, 5⅞-inch through tubing rotary drilling (TTRD) reservoir section was drilled from 10,830 ft from a 60° kick-off angle, dropping to 35° and then building back to 75° at touchdown depth (TD). For the complex well geometry from a maturing oil field, managing equivalent circulating density (ECD) and barite sag would have been problematic using conventionally weighted systems. Formulating a 13 lb/gal oil-based fluid with a micronized, treated barite weighting agent, as described above, meant that very low rheology drilling fluids could be utilized to control ECD and reduce drilling risk. Compared to offset wells, the ECD) was maintained at 13.25 lb/gal, but pump rates were increased by more than 15 gal/min. Shaker screen sizes were reduced from typically 170 and 200-mesh screens to 210 and 250-mesh at 530-gal/min flow rates using the treated barite system. The combination of low fluid rheology and finer shakers screens resulted in drier cuttings discharge and dilution factors were reduced from 5 bbl of fluid lost per bbl of hole drilled to 2.1 bbl/bbl. No mud weight variation was noted after trips and drilling fluid properties remained stable throughout the section.

Case 2

A 4,222-ft, 8½-inch section drilled from 9,075 ft at a hole angle of 60° was drilled, lined, and cemented at TD. The fluid density was 13.7 lb/gal using a micronized treated barite system, as described above, selected to provide greater control of rheology and to increase the margins of drilling risk. ECD's were reduced by up to 0.3 lb/gal towards the end of the section, despite higher pump rates (3,700 lb/$in^2$) than offset wells at the same depth and hole angle. Four shale shakers were configured with three 250-mesh screens, and one 200-mesh screen, which handled the fill flow of 555 gal/min. Dilution factors were reduced from 2.4 to 1.5 bbl fluid lost per bbl hole drilled, and taking into account all losses, fluid consumption was reduced from 4.1 to 2.6 bbl/bbl.

While using the micronized weighting agent, the coefficient of friction inside the casing was measured in the field at 0.15, compared to 0.17 on offset wells. In open hole, the reduction was even more dramatic, with a reduction from 0.19 to 0.14, a 26% reduction. On the same section, the actual torque measured for running the liner was 24 kN-m, compared to a simulated 27 kN-m.

Case 3

A 3,189-ft 5⅞-inch TTRD reservoir section was drilled from 13,441 ft. The maximum inclination was 78° and fluid density was 13.2 lb/gal. The original producing well was plugged and abandoned in the 7-inch tubing, requiring a new well to be drilled out into a new formation from the existing completion to access known pools of hydrocarbons. Due to the narrow annular tolerances, ECD management was critical for this section where a narrow pore pressure and fracture pressure window existed. Hydraulics optimization was further complicated by the need for high flow rates to power a downhole geosteering tool. Drilling fluids using a treated barite system was engineered with characteristically low fluid rheologies (3 rpm reading of 2-3 Fann Units) to control ECD without risking barite settlement at this critical mud weight and to deliver between 135 and 185 gal/min to the geosteering tool. The geosteering tool was successfully deployed in this fluid system and the section was completed without incident. No density variations were noted after trips. The actual ROP was 16 to 18 m/hr, 10% above program at 15 m/hr. Three shakers were configured with top screens of 190 and 210 mesh and bottom screens of 250 mesh which resulted in dilution factors of 3.9 bbl/bbl compared to 8.7 bbl/bbl on offset TTRD wells using conventional oil-based drilling fluid. Overall fluid costs were under budget by 18% as a result.

Case 4

In another 8½-inch reservoir section, a 9,130-ft long section drilled from 12,093 ft with 13.0 lb/gal and 70° sail angle dropping to 57° would have placed severe constraints on ECD control using conventionally weighted drilling fluids. Using a micronized treated barite in an oil-based drilling fluid system, the long inclined section was successfully drilled without incident, including barite settlement. Compared to an offset well drilled in the same area using conventionally weighted fluid of the same bit size and well trajectory, rotary torque in open hole was 26% lower. With 3 of the 5 shakers dressed with either 260 mesh, 270 mesh or 325 mesh, handling full flow at 422 to 500 gal/min, dilution factors were reduced from an average of 1.6 bbl of fluid per bbl of cuttings drilled to 0.87 bbl/bbl. There was no evidence of uneven mud weight after trips. On one occasion towards the end of the 8½-inch section, a bit change necessitated leaving the fluid static in the well for five days. After 5 days static, circulation was broken and the mud weight taken every 10 minutes with no fluctuations in fluid density observed at the flowline, despite the 6 and 3 rpm readings of the treated barite system measuring only 3 and 2 Fann units, respectively.

Case 5

In another 8½-inch reservoir section, a 1,755 ft long section was drilled to 20,472 ft with 11 to 11.5 lb/gal fluid density using an oil-based drilling fluid. Using a micronized treated barite weighting agent at this fluid density, the shale shakers were dressed with 400 mesh screens that successfully removed unwanted drilled cuttings and other debris from the fluid at fill flow of 580 gallons per minute. Compared to offset wells in the vicinity of similar depth and inclination, the solids removal efficiency increased from 40% to 64% and the dilution factors were reduced from an average of 9 bbl of fluid used per bbl of hole drilled to 2.8 bbl/bbl.

In the same reservoir section, a centrifuge was used to further treat the drilling fluid (effluent) after it had passed through the primary separation process using screens. The centrifuge was rotating at 2,500 rpm. Analysis showed that a majority of the micronized weighting agents was retained in the effluent and waste drilled solids greater than 5 microns were removed from the effluent.

Drilling fluid systems having a micronized weighting agent may be used to drill mature reservoirs where the complex well trajectories and narrow drilling tolerances of extended reach drilling, through tubing drilling, and horizontal drilling techniques require high performance and highly engineered drilling fluid systems that are not always attainable with conventionally weighted systems. Compared to conventionally weighted systems, drilling fluids formulated with the micronized weighting agents may deliver improved control on ECD management by virtue of the very low fluid viscosities without compromise on sag or settlement properties in inclined wells. The unique combination of micron-size particles and lower fluid viscosities may enhance solids separation efficiency and reduce dilution factors by up to 65%. In addition rotary torque may be reduced by up to 26% in open hole. The use of micronized weighting agents in drilling and completion fluids may offer substantial benefits for drilling sections in maturing reservoirs by reducing overall drilling risk and cost in wells with complex trajectories.

Advantageously, embodiments disclosed herein may provide one or more of the following: reduced risk of weighting agent sag or settlement; improved ability to formulate thin fluids; improved ECD control; improved downhole tool performance; improved cement job quality; improved solids control efficiency. Embodiments disclosed herein may allow for improved separation efficiency, possibly allowing for a decreased number of separation stages and elimination of the need for excess separation equipment. Other embodiments may allow use of smaller screens, improved solids removal efficiency, less regrinding and recirculation, the recovery of a broader cuttings size, lower surface area per metric ton of cuttings, less fluid on cuttings, and lower dilution factors, Additionally, embodiments disclosed herein may reduce losses of weighting agents and other additives on shakers. For example, in some embodiments, solids removal efficiency may be increased 40% to 65%. The separation efficiency of low gravity solids may be improved in other embodiments.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A method to control drilling fluid properties, the method comprising;

circulating a drilling fluid through a wellbore to form a suspension of drilled solids in the drilling fluid;

passing the suspension through one shale shaker to form a particulate fraction comprising at least a portion of the drilled solids and an effluent fraction that comprises the drilling fluid;

said shale shaker comprising screens;

each of said screens having a minimum particle cut screen size between about 10 microns and about 100 microns;

wherein the particulate fraction comprises particulates having a particle size of 100 microns or greater;

wherein the effluent comprises a micronized weighting agent having a particle size $d_{90}$ of 10 microns or less;

and wherein said screens having a minimum particle cut screen size between about 10 microns and about 100 microns are the only screens used in the method.

2. The method of claim 1, wherein the one shale shaker comprises a screen having an API RP 13C $d_{100}$ of 70 microns to 100 microns.

3. The method of claim 1, wherein the one shale shaker comprises a screen having an API RP 13C $d_{100}$ of 25 microns to 100 microns.

4. The method of claim 1, comprising recycling the effluent to the wellbore.

5. The method of claim 1, wherein the micronized weighting agent comprises at least one selected from barite, calcium carbonate, dolomite, ilmenite, hematite, olivine, siderite, and strontium sulfate.

6. The method of claim 5, wherein the micronized weighting agent further comprises a coating.

7. The method of claim 1, wherein the micronized weighting agent has a particle distribution given by $d_{90}$ ranging from 2 to 8 microns.

8. The method of claim 1, wherein the drilling fluid is one selected from a water-based fluid, an oil-based fluid, and an invert emulsion.

9. The method of claim 1, wherein the circulating step comprises transporting the suspension from the wellbore to the shale shaker without a processing step therebetween, and wherein the screens of the shale shaker are configured to have a minimum particle size cut between about 15 microns and about 100 microns.

10. A process for the separation of components of a mixture of materials, wherein the mixture comprises drilling fluid, drilled solids, and one or more micronized weighting agents from a mud system, the process comprising: passing the mixture through one shale shaker to form a particulate fraction comprising at least a portion of the drilled solids and an effluent fraction that comprises the drilling fluid;

said shale shaker comprising screens;

each of said screens having a minimum particle cut screen size between about 10 microns and about 100 microns;

wherein the particulate fraction comprises particulates having a particle size of 100 microns or greater;

wherein the effluent comprises a micronized weighting agent having a particle size $d_{90}$ of 10 microns or less;

and wherein said screens having a minimum particle cut screen size between about 10 microns and about 100 microns are the only screens used to separate the mixture.

11. The process of claim 10, wherein the one or more micronized weighting agents have a particle size $d_{90}$ of 10 microns or less.

12. The process of claim 10, further comprising recycling the effluent to the mud system.

13. The process of claim 10, wherein the one or more micronized weighting agents comprise at least one selected from barite, calcium carbonate, dolomite, ilmenite, hematite, olivine, siderite, and strontium sulfate.

14. The process of claim 13, wherein the micronized weighting agent further comprises a coating.

15. The process of claim 10, wherein the one shale shaker comprises a screen having an API RP 13C $d_{100}$ of 70 microns 100 microns.

16. A system for the separation of drilling fluid and additives from a mixture of materials, wherein the mixture comprises a base drilling fluid, drilled solids, and one or more micronized weighting agents from a mud system, the system comprising:

a fluid connection to transport the mixture from the mud system to one shale shaker, passing the mixture through the one shale shaker to form a particulate fraction comprising at least a portion of the drilled solids and an effluent fraction that comprises the drilling fluid;

said shale shaker comprising screens;

each of said screens having a minimum particle cut screen size between about 10 microns and about 100 microns;

wherein the particulate fraction comprises particulates having a particle size of 100 microns or greater;

wherein the effluent comprises a micronized weighting agent having a particle size $d_{90}$ of 10 microns or less;

and wherein said screens having a minimum particle cut screen size between about 10 microns and about 100 microns are the only screens used in the system.

* * * * *